US008037831B2

(12) United States Patent
Zhang et al.

(10) Patent No.: US 8,037,831 B2
(45) Date of Patent: Oct. 18, 2011

(54) SUPER COMPRESSED DETONATION METHOD AND DEVICE TO EFFECT SUCH DETONATION

(75) Inventors: Fan Zhang, Medicine Hat (CA); Stephen Burke Murray, Medicine Hat (CA); Andrew J. Higgins, Montreal (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 2 days.

(21) Appl. No.: 12/952,769

(22) Filed: Nov. 23, 2010

(65) Prior Publication Data

US 2011/0061553 A1 Mar. 17, 2011

Related U.S. Application Data

(60) Division of application No. 12/379,609, filed on Feb. 25, 2009, now Pat. No. 7,861,655, which is a division of application No. 10/932,095, filed on Sep. 2, 2004, now Pat. No. 7,513,198, which is a continuation-in-part of application No. 10/459,714, filed on Jun. 12, 2003, now abandoned.

(51) Int. Cl.
*F42B 10/00* (2006.01)
*D03D 23/00* (2006.01)

(52) U.S. Cl. ..... 102/475; 149/109.6

(58) Field of Classification Search ..... 102/475; 149/109.6

See application file for complete search history.

(56) References Cited

U.S. PATENT DOCUMENTS

| | | | |
|---|---|---|---|
| 2,984,307 | A | 5/1961 | Barnes |
| 3,022,544 | A | 2/1962 | Coursen et al. |
| 3,023,462 | A | 3/1962 | Taylor et al. |
| 3,220,103 | A | 11/1965 | Simons |
| 3,238,019 | A | 3/1966 | De Carli |
| 3,529,324 | A | 9/1970 | Kawai |
| 3,561,361 | A | 2/1971 | Kessenich et al. |
| 3,608,014 | A | 9/1971 | Balchan et al. |
| 3,611,932 | A | 10/1971 | Clator |
| 3,653,792 | A | 4/1972 | Martin, III |
| 3,658,268 | A | 4/1972 | Garrett |
| 3,659,972 | A | 5/1972 | Garrett |
| 4,372,214 | A | 2/1983 | Toton et al. |
| 4,377,565 | A | 3/1983 | Setaka |

(Continued)

FOREIGN PATENT DOCUMENTS

CA 2123170 11/1995

(Continued)

OTHER PUBLICATIONS

Search report on EP 05004978.2, Aug. 15, 2005.

(Continued)

*Primary Examiner* — Aileen B Felton
(74) *Attorney, Agent, or Firm* — Hans Koenig

(57) ABSTRACT

A method for effecting physicochemical transformations and detonation properties in a material using super-compressed detonation includes: providing an insensitive energetic material to be compressed; super-compressing the material by exposure to at least one of a normally or obliquely oriented cylindrical imploding shock wave, generated from a first detonation; effecting transformations from the super-compression in the material including increasing at least material density, structural transformations and electronic energy gap transitions relative to a material unexposed to the super-compression; exposing the super-compressed material to a second detonation; and effecting transformations from the second detonation in the material including increasing at least detonation pressure, velocity and energy density relative to a material unexposed to the super-compression and second detonation.

11 Claims, 4 Drawing Sheets

U.S. PATENT DOCUMENTS

| | | | |
|---|---|---|---|
| 4,387,773 | A | 6/1983 | McPhee |
| 4,450,768 | A | 5/1984 | Bell |
| 4,552,742 | A | 11/1985 | Mayer |
| 4,790,735 | A | 12/1988 | Mayer |
| 4,896,609 | A | 1/1990 | Betts et al. |
| 4,901,619 | A | 2/1990 | Sassmannshausen et al. |
| 4,987,818 | A | 1/1991 | Alford |
| 5,024,159 | A | 6/1991 | Walley |
| 5,251,561 | A | 10/1993 | Murphy |
| 5,447,104 | A | 9/1995 | Lebet et al. |
| 5,467,714 | A | 11/1995 | Lund et al. |
| 5,544,589 | A | 8/1996 | Held |
| 5,847,312 | A | 12/1998 | Walters et al. |
| 5,859,383 | A | 1/1999 | Davison et al. |
| 5,996,501 | A | 12/1999 | Spencer et al. |
| 6,668,726 | B2 | 12/2003 | Lussier |
| 2003/0037692 | A1 | 2/2003 | Liu |
| 2005/0013760 | A1 | 1/2005 | Ito et al. |

FOREIGN PATENT DOCUMENTS

| | | |
|---|---|---|
| CA | 2453021 | 12/2004 |
| CA | 2460762 | 12/2004 |
| CA | 2579314 | 3/2006 |
| FR | 1033565 | 7/1953 |
| FR | 2061824 | 6/1971 |
| WO | WO 2006/024137 | 3/2006 |

OTHER PUBLICATIONS

Written Opinion of the ISA on WO 2006-024137, Nov. 30, 2005.
International Preliminary Report on Patentability on WO 2006-024137, Jan. 11, 2007.
Carton, E.P., et al., J. Appl. Phys., 81(7): 3038-3045 (1997).
Collins, G.W., et al., Science, 281: 1178-1181 (1998).
Da Silva, L.B., Physical Review Letters, 78(3): 483-486 (1997).
Dabora, E.K. et al., Tenth Symposium (International) on Combustions, The Combustion Institute, p. 817-830 (1955).
Eremets, M.I., et al., Nature, 410: 170-174 (2001).
Fay, J.A., The Physics of Fluids, 2(3): 283-289 (1959).
Fowles, G.R., et al., Journal of Applied Physics, 36(4): 1377-1379 (1965).
Fujiwara, K., et al., Appl. Phys. Lett., 61(26): 3110-3112 (1992).
Hawke, R.S. "Design and Analysis of Isentropic Compression Experiments" in Megagauss Physics and Technology, P.J. Turchi (ed), (Plenum Press, New York), p. 117-130 (1980).
Hemley, R.J., et al. Physical Review Letters, 61(7): 857-860 (1988).
Hiroe, T., et al., American Institute of Physics, p. 977-980 (1996).
Kaliski, S., Proceedings of Vibration Problems, 15(1): 3-15 (1974).
Meyers, M.A., et al., Acta Metall., 36(4): 925-936 (1988).
Meyers, M.A., Dynamic Behavior of Materials (John Wiley & Sons, Inc., New York) p. 314-318 (1994).
Mitchell, A.C., et al., J. Chem. Phys., 76(12): 6273-6281 (1982).
Narayana, C., et al., Nature, 393: 46-49 (1998).
Nellis, W.J., et. al., Shock Waves, p. 301-305 (1999).
Pavlovskii, A.I. et al., "Isentropic Solid Hydrogen . . . ", in Megagauss Technology and Pulsed Power Applications, Fowler et al. (eds) (Plenum Press, New York) p. 255-262 (1987).
Urlin, V.D., et al., JETP, 84(6): 1145-1148 (1997).
Weir, S.T., et al., Physical Review Letters, 76(11): 1860-1863 (1996).
Winterberg, F., J. Phys. D: Appl. Phys., 9: L105-L108 (1976).
Yoshinaka, A., et al., "Initiation of Detonation . . . ", Conference on Shock Compression of Condensed Matter, 2005, Baltimore, Maryland, AIP Proceedings, p. 1139-1142 (2006).
Yoshinaka, A. et al., "Shock Initiation and Detonability . . . " Conference on Shock Compression of Condensed Matter, 2003, Portland, Oregon, AIP Proceedings, p. 1069-1072 (2004).
Zerwekh, W.D., et al., American Institute of Physics, p. 1877-1880 (1994).
Zhang, F., et al., "Shock Initiation and Detonability of Isopropyl Nitrate," Proceedings of the 12th International Detonation Symposium, San Diego, p. 781-790 (2002).
Zhang, F., et al., Ab Initio Molecular Dynamics on Energetic Materials and Detonation Mechanisms, DRDC Technical Report TR 2003-156 (2003).
Higgins, J.A., et al., "Initiation of Detonation in Liquid Explosives . . . " Proceedings of the 12th International Detonation Symposium, San Diego, p. 993-1000 (2002).
Office Action of Jan. 15, 2004 on U.S. Appl. No. 10/459,714.
Office Action of Apr. 2, 2004 on U.S. Appl. No. 10/459,714.
Office Action of Jun. 8, 2006 on U.S. Appl. No. 10/793,777.
Office Action Sep. 19, 2006 on U.S. Appl. No. 10/793,777.
Office Action of Dec. 13, 2007 on U.S. Appl. No. 10/932,095.

SUPER COMPRESSED DETONATION METHOD AND DEVICE TO EFFECT SUCH DETONATION

CROSS-REFERENCE TO RELATED APPLICATIONS

This application is a divisional of U.S. patent application Ser. No. 12/379,609 filed Feb. 25, 2009, the entire contents of which are herein incorporated by reference, which is a divisional of U.S. patent application Ser. No. 10/932,095 filed Sep. 2, 2004 and issued on Apr. 7, 2009 under U.S. Pat. No. 7,513,198, which is a continuation-in-part of U.S. patent application Ser. No. 10/459,714, filed Jun. 12, 2003 now abandoned.

FIELD OF THE INVENTION

The present invention relates to super compressed detonation and more particularly, the present invention relates to detonation of super-compressed insensitive energetic materials to alter the physicochemical and detonation properties and a device to effect this result.

BACKGROUND OF THE INVENTION

A panoply of efforts have been purported to affect materials by high-pressure compression. Exemplary of the techniques having been established include the use of diamond anvil technology for the compression of molecular solid hydrogen above 3 megabars. The process was useful in terms of generating a significant density increase and phase transformations. This work was further augmented by others where solid nitrogen was compressed into the megabar range where it was then observed to provide a semi-conducting polymeric phase. Two-stage light gas gun technology has been employed as an alternative approach to pursue compression of liquid hydrogen into the megabar range where the hydrogen becomes conductive. These techniques are limited to the observation of very small samples in several to tens of micrometers at megabar pressures.

In terms of the parallel contemporary progress in this field, compression of large samples has been achieved most recently using explosive based cylindrical methods. These processes, when unified, have also produced extremely high pressures in materials.

In the prior art, general attempts to provide shaped charge arrangements have been demonstrated. One example is that which is illustrated in the Barnes U.S. Pat. No. 2,984,307. The Barnes reference teaches an annular shaped charge effect focusing at a location out of the apparatus body. Accordingly, the structure of the apparatus is incapable of providing detonation in a super-compressed insensitive energetic material within the body of the apparatus.

In the Barnes arrangement, the device is structured to be a housing for hosting an annular explosive that provides the power for the cavity effect of the shaped charge focusing on the position out of the apparatus body. The structure of the housing and the encased explosive together with the entire structure of the apparatus cannot form a precisely controlled normal or oblique detonation wave, which is most desirable for imploding compression applications, even if an anvil surrounded by explosive material were added at the center of the apparatus.

In the drawings of the Barnes arrangement, element 30 is simply a further version of the housing replacing housing 10 to host the annular explosive for the same shaped charge effect with a slightly different cross-section to reduce hosted explosive mass indicated by numeral 34. This is structured to be the replacement of explosive 12, not surrounded by explosive 12. There is no means for housing 30 to be used as a sample anvil.

It was subsequently discovered that a cylindrical metal liner could be imploded by an explosive to compress the magnetic flux in the annular gap between a liner and sample tube. It was determined that by increasing the magnetic field, the metal sample tube was compressed which, in turn, isentropically compressed the hydrogen fluid contained in the sample tube. Radiography was employed to determine diameter changes and by this technology, it was observed that the hydrogen density was increased fourteen-fold. Further compression systems employing explosive implosion devices without magnetic flux have also advanced the art.

One of the most common features to such arrangement is that the implosion generally occurs simultaneously along the length of the sample and is driven by a converging detonation wave propagating at a direction normal to and toward the axis.

In contrast, other conducted studies of cylindrical implosion of a sample have been set forth in which a Chapman-Jouguet (CJ) detonation propagating through an explosive parallel to the axis compresses the sample in an axially sequential fashion. When these latter implosion systems are compared with those driven by radially propagating detonation, they are found to be easier to implement, but result in lower compression. Between the two limits of an explosive detonation propagating normally to the axis and that propagating parallel to the axis, there exist cylindrical compression systems driven by oblique explosive detonation propagating at an angle to the axis as discussed by Zerwekh et al. (Zerwekh, W. D., Marsh, S. P. and Tan T.-H., AIP Conference Proceedings 309:1877-1880, 1994). They developed a phased shock tube system, in which a cylindrical steel flyer was explosively propelled inward and impinged on a conical aluminum-phasing lens. This initiated an oblique detonation wave in a cylindrical shell of high explosive and resulted in a Mach disk shock propagating in an axial cylinder of foamed polystyrene sample. The device functioned like a shock tube and the Mach disk shock created has been employed to propel a 1.5 mm thick steel disk above 10 km/s. Recently, Carton et al. employed a two-layer explosive configuration to obtain an oblique detonation wave, whose angle is determined by the ratio of the fast detonation velocity of the outer explosive over the slow detonation velocity of the inner explosive (Carton, E. P., Verbeek, H. J, Stuivinga, M. and Schoomnan, J., J. Appl. Phys. 81:3038-3045, 1997). This device has been used for dynamic compaction of powders and the axial compaction wave velocity is limited to the CJ detonation velocity of the outer explosive.

In summary, recent high-pressure compression technologies have been successful in achieving dynamic compaction of powders or compressing a molecular liquid to a super-dense fluid, whose density is several-fold the initial density with structural phase transformations, electronic energy-gap closing and the presence of atomic particles. The cylindrical explosive implosion technologies have been developed to compress materials and mainly operated in two generic driving modes: explosive converging detonation propagating in a direction normal to and towards the axis, or explosive CJ detonation propagating parallel to the axis.

Efforts have also been purported to ignite thermonuclear explosions by explosive implosion techniques.

Methods and technologies have not been developed for detonation of super-compressed, conventional reactive materials to alter the detonation velocity and pressure. Super-compression means a pressure level of close to or above the range of one megabar.

Generally, the effectiveness of munitions involving detonation of explosive materials largely depends on the detonation velocity and pressure in the explosion phase of the detonation. Existing technologies deliver detonation velocities and pressures in the range of a few kilometres per second and several hundred kilobars, respectively.

SUMMARY OF THE INVENTION

The present invention provides an improved method and device for detonation of super-compressed, insensitive energetic materials to effect physicochemical changes and enhance detonation properties.

A method for effecting physicochemical transformations and detonation properties in a material using super-compressed detonation comprising:

providing an insensitive energetic material to be compressed;

super-compressing the material by exposure to at least one of a normally or obliquely oriented cylindrical imploding shock wave, generated from a first detonation;

effecting transformations from the super-compression in the material including increasing at least material density, structural transformations and electronic energy gap transitions relative to a material unexposed to the super-compression;

exposing the super-compressed material to an axially oriented second detonation; and effecting transformations from the second detonation in the material including increasing at least detonation pressure, velocity and energy density relative to a material unexposed to the super-compression and second detonation.

A method for inducing cylindrical reverberating shock waves for compressing a material exposed thereto is based on a principle referred to as "impedance matching", in which the pressure and particle velocity are conserved across the boundary existing between materials when a shock wave passes form one material to another, and comprises:

providing an explosive-clad conical metal flyer shell with an explosive contained therein and an interior cylindrical metal anvil having a central rod and containing a material to be compressed;

detonating the explosive cladding to accelerate the flyer shell;

detonating the contained explosive by impact from the flyer shell to form imploding shock waves impinging the anvil, where the imploding shock waves can be either normal or oblique, determined by the conic angle of the flyer shell;

compressing the material by the imploding shock wave transmitted through the anvil wall;

implosion of the shock wave at the central rod;

reflecting a diverging shock wave from the implosion through the material for further compression; and further reverberating shock waves between the anvil wall and central rod to compress the material to a desired high pressure and density.

By the present technology, a completely new strategy was employed which effectively consists of two sequentially timed events. The events include the cylindrical oblique implosion with subsequent reverberating shocks for material super-compression and axial detonation of the precompressed material to achieve a detonation velocity several times that of TNT and a detonation pressure more than ten times that of TNT. It has been observed that there is a significant increase in the resident energy in the compressed sample which is a direct consequence of the increased material density coming from the sequential wave compression. It has also been recognized that structural transformations in the material together with recombination of free atoms and ions also augment the resident energy, and therefore detonation pressure and velocity.

It will be appreciated by those skilled in the art that this technology is obviously increasing the effectiveness of munitions that depend on the magnitude of detonation velocity and pressure in the detonation phase of explosive materials. This technology also opens applications for a new class of energetic materials, namely, high energy release of insensitive energetic materials via super-compression.

As a feature of the instant technology, one principle developed in this invention is particularly important, namely "velocity-induction matching". In this method, a sample material is exposed to compression by an oblique shock wave system that propagates steadily in the axial direction at any given velocity. In addition, variation of the diameter, wall material and thickness of the sample anvil provides a wide range of time during which the sample material is exposed to the compression by the oblique shock wave system. Thus, the device can be designed in a manner such that the compression time and axial velocity of the oblique shock wave system match the induction delay time and the detonation velocity of the compressed sample material. Since the resultant wave structure is self-organizing, a super-compressed detonation can automatically propagate in any length of sample material.

One object of one embodiment of the present invention is to provide a method for enhancing detonation properties in any length of material using detonation in super-compressed materials according to velocity-induction matching, comprising:

providing any length of an insensitive energetic material to be compressed and detonated with known detonation velocity and induction delay time under conditions of compression;

providing an explosive-clad conical metal flyer shell with an explosive therein and an interior cylindrical metal anvil having a central rod and containing the material;

determining the angle of the flyer shell by matching the axial velocity of an oblique shock wave system to be generated in the material to the detonation velocity of the compressed material;

determining the diameter, wall material and thickness of the anvil by matching the compression time exposed to the oblique shock wave system to the induction delay time of the compressed material;

compressing the material to desired density using the oblique shock wave system generated by the reverberation method;

auto ignition of a super-compressed detonation wave following the oblique shock wave system after the induction delay; and quasi-steady propagation of the super-compressed detonation over the length of the material.

With respect to the apparatus, the arrangement of the elements has resulted in the generation of a quasi-steady super-compressed detonation wave.

A further object of one embodiment of the present invention is to provide a method for effecting anti-armour and anti-hard-target munitions, comprising:

providing an anti-armour or anti-hard-target projectile;

detonation of a material under super-compression;

propelling and shaping the projectile by the super-compressed detonation; and enhancing the projectile penetration capabilities including increasing at least kinetic energy and flying body velocity.

A still further object of one embodiment of the invention is to provide a device for detonation of super-compressed materials, comprising:

an explosive-clad metal flyer shell having a substantially conical cross section;

a lid on the flyer shell including explosive material and a detonator therefor;

an interior metal anvil disposed within the flyer shell for retaining a sample material to be compressed or to be detonated, and being substantially surrounded by explosive; and alignment means for maintaining alignment of the explosive, anvil and the flyer shell.

Having thus generally described the invention, reference will now be made to the accompanying drawings, illustrating preferred embodiments.

BRIEF DESCRIPTION OF THE DRAWINGS

Similar numerals employed in the text denote similar elements.

DETAILED DESCRIPTION OF THE PREFERRED EMBODIMENT

Figure 1:
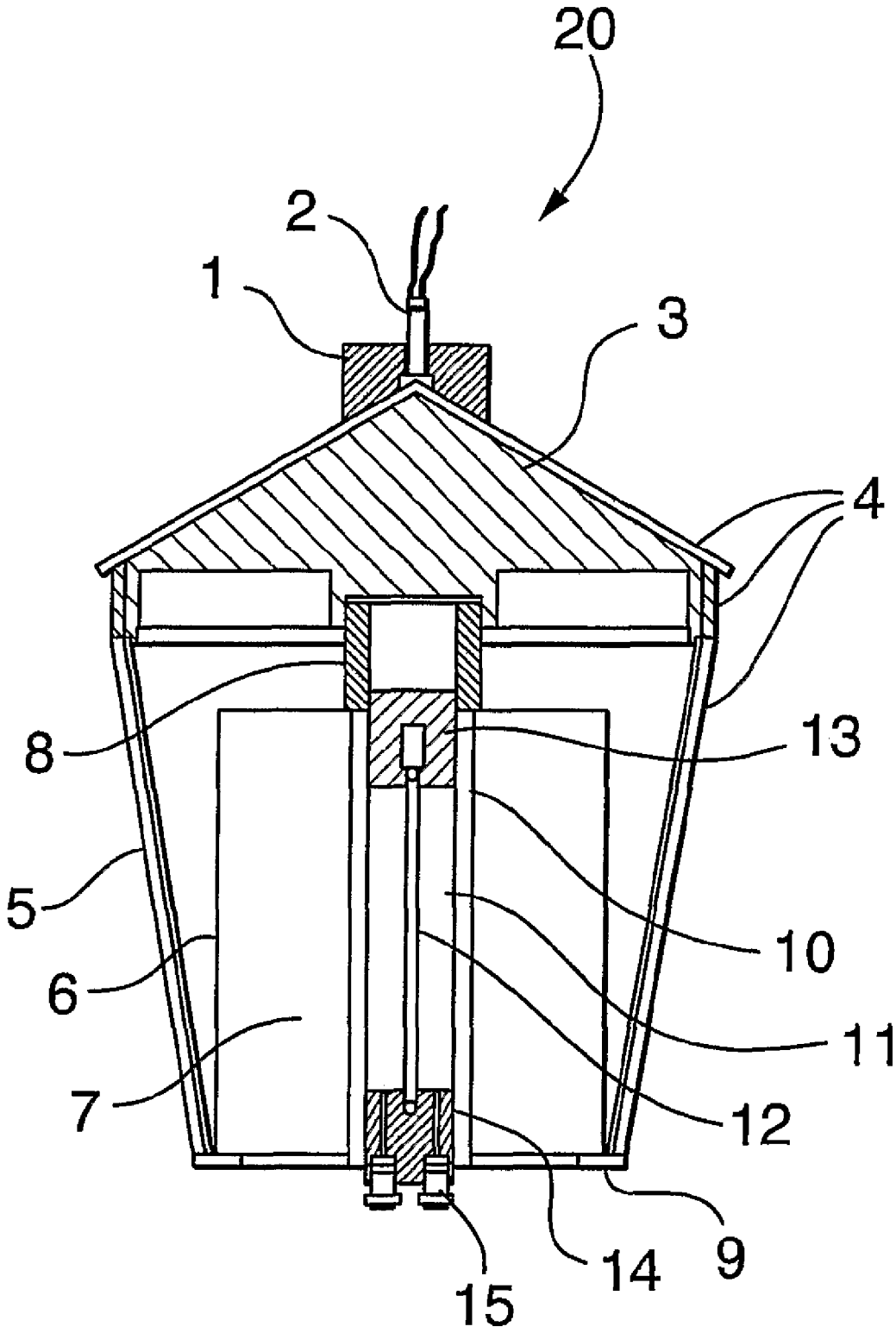
FIG. 1 is a longitudinal cross section of the device in accordance with one embodiment.

Referring now to FIG. 1, numeral 20 globally references the device. The arrangement has a conical metal flyer shell 5, base plate 9 and cone shaped lid 3. In use, the device is retained with lid 3 in position as depicted.

The lid comprises low density foam and provides sheets of explosive 4, which also clad the flyer shell 5 with the exception of the base plate 9. Mounted at the apex of the lid 3 is a detonator 2 secured to the former by holder 1. The device 20 positions a sample holder (discussed herein after) in coaxial relation with the apex of lid 3 and consequently detonator 2.

In greater detail with respect to the sample holder, the holder comprises a metal anvil 10 containing an insensitive energetic sample material 11. The anvil 10 has a top plug 13 and a bottom plug 14 which locate and retain a centrally disposed rod 12. A centering sleeve 8 ensures coaxial alignment of rod 12 and anvil 10 with lid 3 and detonator 2. In the case of liquid sample material, sealing caps 15 are provided in plug 14.

Surrounding anvil 10 is high explosive 7, which, in turn, is surrounded by an aluminium casing 6.

In anti-armour and anti-hard-target applications, bottom plug 14 is replaced by a projectile (not shown).

In operation, detonator 2 is activated to create a circular detonation wave pattern propagating through explosive sheets 4 on lid 3 and flyer shell 5. The circular detonation wave induces symmetric implosion of the flyer shell 5 to impact casing 6 in a continuous manner with respect to its length from the top to the bottom. Lid 3 is also structured to avoid undesired initiation of high explosive 7 directly by the circular wave.

These activities generate the inception of a normal or oblique detonation wave in high explosive 7, depending on the angle of the conical flyer shell. For super-compressed detonation, the conic angle of the flyer shell is designed to produce an oblique detonation wave which travels through high explosive 7 resulting in the subsequent transmission of a cylindrical oblique shock wave. This wave is transmitted through the anvil 10 and into the sample for compression of the sample. Implosion of this wave occurs at the rod 12 with reflection of a cylindrical shock wave to the wall of anvil 10. The central rod is also critical to avoid high implosion temperatures which could prematurely initiate the compressed material. The waves reverberate between the wall and the rod 12 for cyclical compression of the material in anvil 10 to a predetermined density and pressure within a compression zone thickness corresponding to a compression time.

Figure 2:
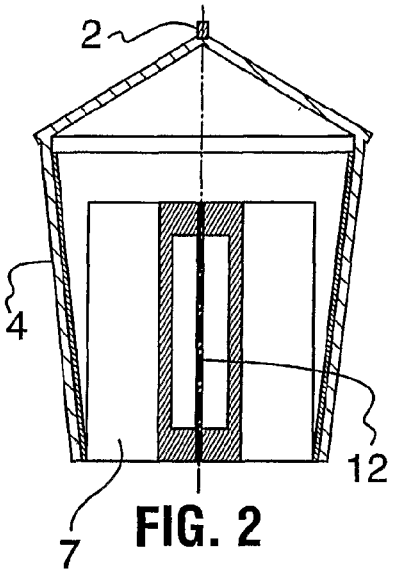
FIG. 2 is a schematic illustration of the device shown in FIG. 1.

The wave process will be discussed in connection with FIGS. 2 and 3. The angle of the flyer shell 5 is selected so that the flyer shell impacts the cylindrical boundary of the high explosive from top to bottom. As discussed previously, an oblique imploding detonation wave is generated and propagates in the explosive with a velocity $D_1$ at an incident angle $\phi$ to the wall of anvil 10. The oblique detonation wave transmits an oblique shock wave having a front velocity $U_S$ axially along the wall of anvil 10 and into the material in anvil 10. This incident oblique shock wave compresses the material while imploding towards the axis. Implosion at the central rod forms a reflected diverging shock wave for further compression.

As mentioned in the text, when a boundary exists between materials to which are exposed a shock wave, pressure and particle velocity are maintained. This property can be exploited in a process known as "impedance matching", in which the appropriate choice of anvil and central rod materials and component thicknesses, including the high explosive, can result in controlled reverberating shock waves between the sample anvil wall and the central rod that compress the sample to a desired high pressure and density. These multiple dynamic compressions heat the sample quasi-isentropically and result in a final temperature lower than would be achieved by a single shock resulting in the same final pressure. The compression time $t_C$ in which the sample material is compressed to a desired density can be controlled via impedance matching and the selection of thickness of components so that it is sufficiently long to achieve equilibrium, yet does not exceed the induction delay time for a given sample material. The latter is important to avoid premature chemical reactions.

Figure 4:
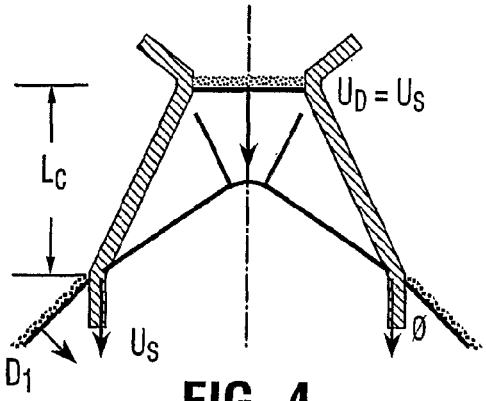
FIG. 4 is a schematic illustration of the wave structure parameters.

To achieve a stable detonation in the super-compressed sample material in any length, a critical method called "velocity-induction matching" is developed in this invention and described below. If designing the device for a known sample material such that (i) the compression time $t_C$ equals the induction delay time $t_I$ of the material, and (ii) the shock front velocity $U_S$ equals the energy release velocity $U_D$ of the material at the desired state of compression, a detonation wave can be automatically initiated at the compression time $t_C$ and can propagate quasi-steadily with a velocity $U_D=U_S$. Since the wave structure is quasi-steady and self-organizing, the resultant super-compressed detonation wave can propagate in any desired length of sample material. The structure of the quasi-steady, super-compressed detonation wave is illustrated in FIG. 4, for which the following relations are obeyed:

$$U_S = D_1/\sin\phi \quad (1)$$

$$L_C = U_S t_C = U_S t_I \quad (2)$$

$$U_D = U_S \quad (3)$$

where $U_S$, is axial velocity of the oblique shock front at the sample periphery;

$D_1$, is high explosive detonation velocity;

$\phi$, wave incident angle with respect to the axis;

$L_C$, thickness of the compression zone;

$t_C$, compression time;

$t_I$, the induction delay time; and $U_D$, detonation velocity in the super-compressed sample material.

Axial shock front velocity $U_S$ can be matched to the detonation wave velocity $U_D$ for a given material by selection of a value for the angle of the conical flyer shell 5. This is the case because, for a given detonation velocity of the compressed material, there exists a unique angle of the conical flyer shell whose impact results in an oblique shock wave with axial front velocity equaling the detonation velocity. By increasing the angle of the flyer shell, the shock front velocity $U_S$ can be varied continuously from a value just above the CJ detonation velocity of the high explosive to infinity (theoretically). The latter situation corresponds to the normal cylindrical implosion in which the detonation wave in the high explosive propagates in the normal direction towards the axis. In reality, due to practical limitations of materials and dimensions, the axial shock velocity is limited to a few tens of kilometers per second. Matching the compression time $t_C$ to the induction delay time $t_I$ for a given test material can be done by changing the compression time via the impedance matching and the selection of specific thickness of the device components, and also by changing the induction delay time via the addition of chemical additives that can alter the material sensitivity.

Figure 3:
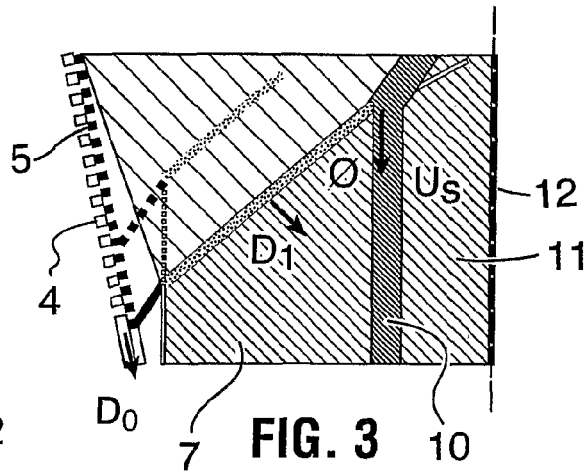
FIG. 3 is a schematic illustration of the parameters during detonation.

The unique relation between the angle of the flyer shell, $\theta$, and the axial velocity of the oblique shock front, $U_S$, is derived to be:

$$\theta = \tan^{-1}(V/D_0) - \sin^{-1}(D_0 V/[U_S(D_0^2+V^2)^{1/2}]) \quad (4)$$

where $D_0$ is the detonation velocity of the explosive sheet on the flyer shell as illustrated in FIG. 3. The variable V can be obtained by the known Gurney equation:

$$V = (2E)^{1/2}\{3/[1+5(M/C)+4(M/C)^2]\}^{1/2} \quad (5)$$

where E is the Gurney energy of the explosive sheet, and M/C is the mass ratio of the explosive sheet and the flyer shell crossing their thickness. Thus, for a given detonation velocity $U_D$ of the compressed material, the angle of the flyer shell $\theta$ can be uniquely determined from solving equations (3), (4) and (5). The remaining parameters of the device can be calculated by the well known shock and detonation dynamics theory, Final adjustment is made in limited experiments for a specific insensitive energetic material.

Figure 5:
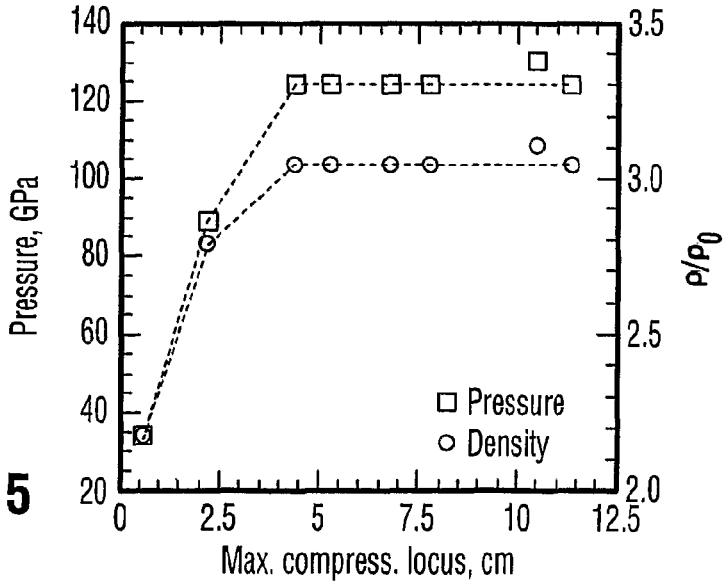
FIG. 5 is a graphical representation of experimental results of density and evaluated pressure as a function of axial position of the compression locus in distilled water.
Figure 6A:
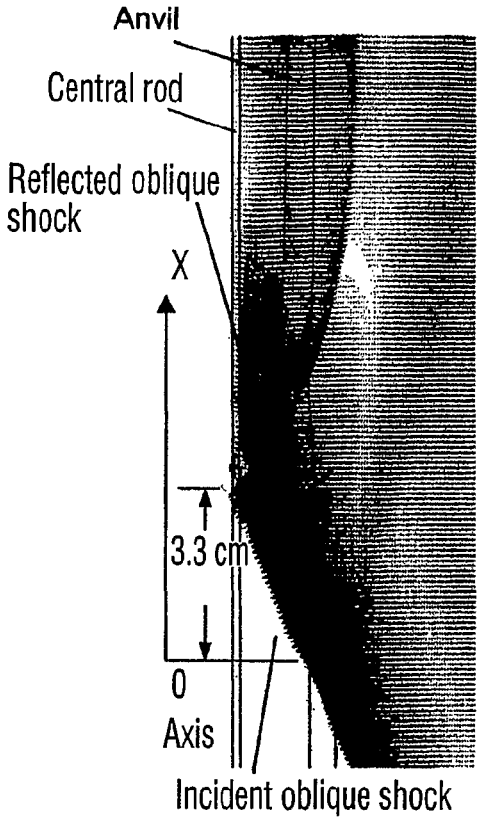
FIGS. 6A through 6E are representative of numerical data for pressure and density in the radial direction at various cross-sections of compressed distilled water.
Figure 6C:
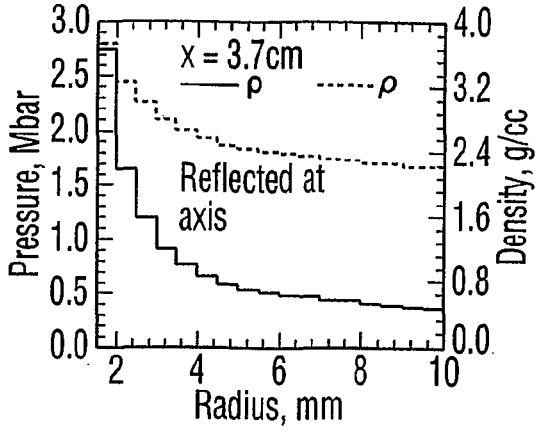
Figure 6D:
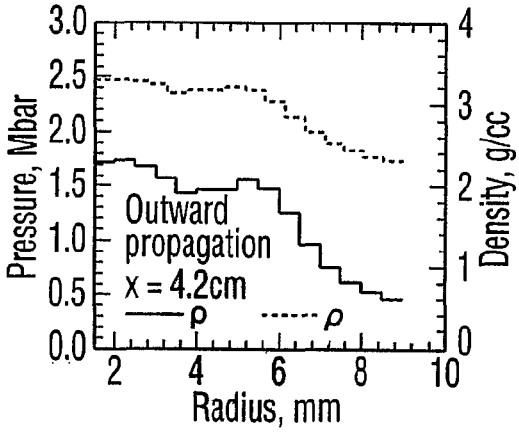
Figure 6B:
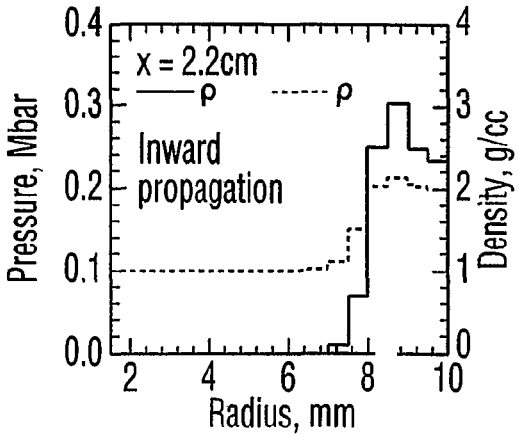
Figure 6E:
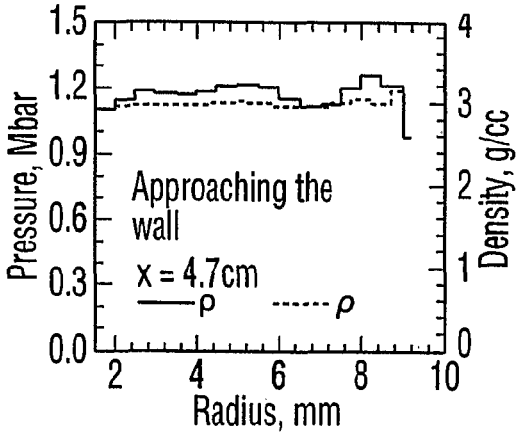

FIG. 5 is a graphical representation of experimental results of sample material density and evaluated pressure as a function of axial position of the compression locus in distilled water for a given angle of the conical flyer shell.

Axial propagation history of the sample material density was obtained from X-ray radiographs by measuring the change in the internal diameter of the sample anvil. For this purpose, the volume change caused by the increase in the sample anvil length was neglected. In the experiments, sample anvil length variations did not exceed 4%. Having obtained the densities, the corresponding pressures were calculated according to the known experimental double-shocked equation of state for the sample material.

FIG. 5 indicates that the quasi-steady compression wave structure is established after an initial axial propagation distance of 3 to 4 cm, after which the maximum compression is achieved resulting in three times the initial density and a pressure of 1.24 megabars.

FIGS. 6A through 6E display numerically calculated pressure and density profiles in distilled water in the radial direction at four cross sections corresponding to axial distances of x=2.2 cm, 3.7 cm, 4.2 cm and 4.7 cm, where x=0 refers to the cross-section at which the oblique shock front enters the sample material. These profiles clearly indicate the reverberating oblique waves between the central rod and the wall of the sample anvil. When the reflected shock wave off the central rod approaches the anvil wall, the maximum compression is achieved. The pressure and density profiles remain relatively uniform in the radial direction following the point of maximum compression.

An example of the device designed according to the principles of this invention for an insensitive energetic liquid mixture of nitroethane and isopropyl nitrate comprises:

a 2.0 mm thick aluminum flyer shell having a conic cross section with a 6.3 degree conic angle, a 133 mm internal diameter at the bottom, a 229 mm height, and a 3.2 mm thick PETN explosive sheet thereon;

a rigid urethane foam lid having a 120 degree apex angle, a 3.2 mm thick PETN explosive sheet and a Reynolds No. 83 detonator thereon;

a 5 mm thick stainless steel sample anvil having a 30 mm internal diameter and a 206 mm height, the anvil being surrounded by 51 mm thick composition C4 explosive contained in a 1.3 mm thick aluminum casing;

the anvil containing a gasless liquid mixture of nitroethane and isopropyl nitrate in a weight ratio of 50/50, the anvil being sealed by two nylon plugs with two nylon caps on the bottom plug, the plugs retaining a 6 mm thick and 166 mm long central Teflon rod; and alignment including a plastic centering sleeve having a 7 mm thickness, a 30 mm internal diameter and a 36 mm height, and an aluminum base plate having a 40 mm hole in the center to align the anvil, a 2.7 mm thick and 137 mm diameter disk with a 3 mm thick edge to align the flyer shell.

Experimental diagnostics include X-ray radiographs for measuring cross section density determined by the change in the internal diameter of the anvil, 0.1 mm wire probes to measure the axial velocity of the oblique shock front along the external wall of the anvil, A PIN type photodiode connected to an optical fiber to record continuous luminosity (also average detonation velocity) generated by the detonation through a window in the bottom plug, and an in-situ velocity probe using the central rod in the anvil to measure the detonation velocity.

Figure 7:
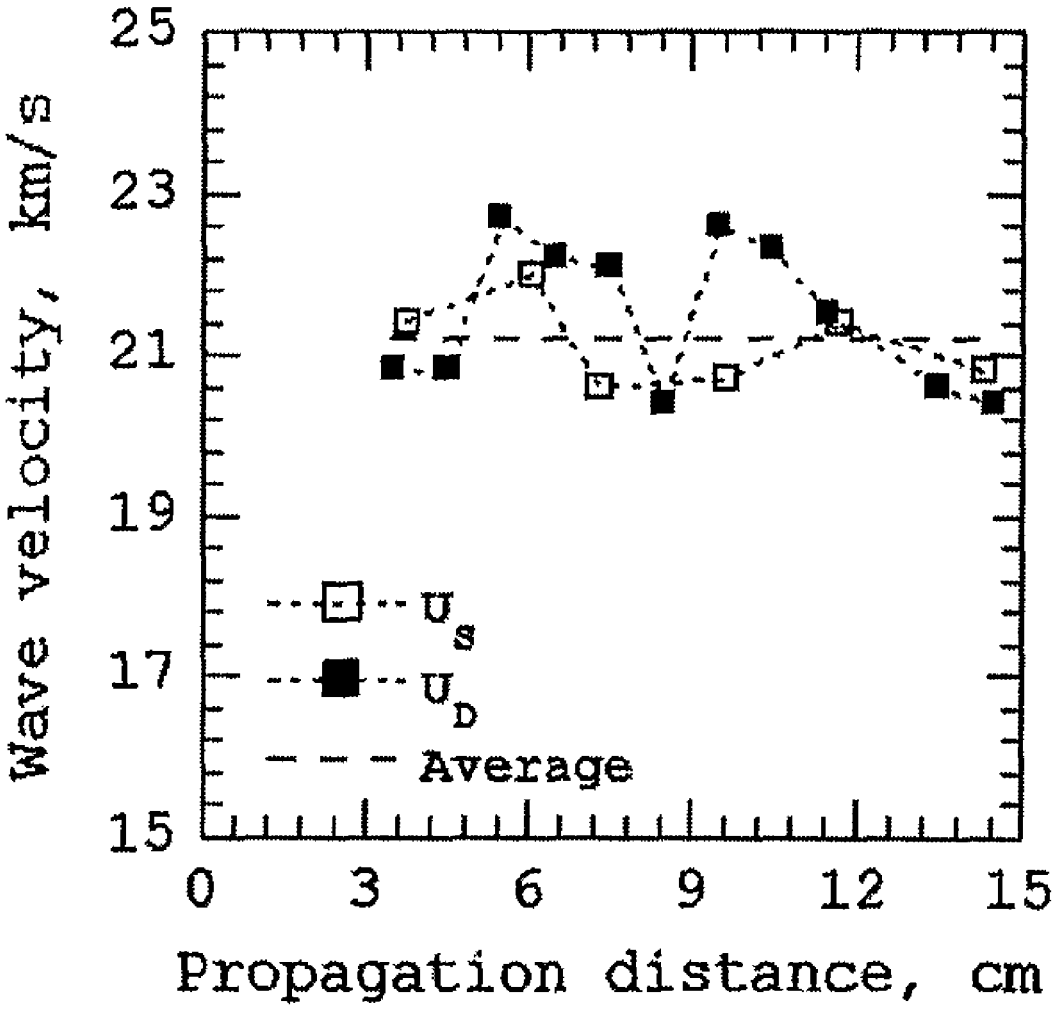
FIG. 7 is graphical representation of the results of experimental shock and detonation velocities for a super-compressed detonation wave that propagates quasi-steadily at a velocity of 21.2 km/s in an insensitive energetic liquid material.

This device for the specific liquid mixture experimentally produced a super-compression of three times the initial liquid density (with an approximately 1.2 megabar pressure evaluated) and subsequent detonation wave in the compressed liquid that propagates quasi-steadily at an average velocity of 21.2 km/s over the length of the liquid after an initial transient propagation distance of 3 to 4 cm as depicted in FIG. 7. The detonation is coupled with the shock such that the detonation velocity equals the axial leading shock velocity accurately to within a ±6.5% maximum deviation from the average velocity.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A method for effecting physicochemical transformations and detonation properties in a material using super-compressed detonation, comprising:

providing an insensitive energetic material to be compressed;

super-compressing said material by exposure to at least one of a normally or obliquely oriented cylindrical imploding shock wave, generated from a first detonation;

effecting transformations from said super-compression in said material including increasing at least material density, structural transformations and electronic energy gap transitions relative to a material unexposed to said super-compression;

exposing the super-compressed material to a second detonation; and effecting transformations from the second detonation in the material including increasing at least detonation pressure, velocity and energy density relative to a material unexposed to the super-compression and second detonation.

2. The method as set forth in claim 1, further including the step of exposing compressed material from said first detonation to reverberating shock waves from said first detonation.

3. The method as set forth in claim 2, wherein said material exposed to said imploding shock wave and subsequent reverberating shock waves is compressed to a pressure of between one and ten megabars.

4. The method as set forth in claim 2, wherein detonation of said super-compressed material results in a detonation velocity more than three times that of TNT and a detonation pressure greater than ten times the detonation pressure of TNT.

5. The method as set forth in claim 1, wherein said first detonation and said second detonation are sequential.

6. The method as set forth in claim 1, wherein said first detonation, when an oblique imploding detonation wave, results in an oblique shock wave being transmitted through said material to be compressed.

7. The method as set forth in claim 6, wherein said oblique shock wave induces reverberating shock waves in said sample for a plurality of sequenced compression phases.

8. The method as set forth in claim 7, further including the step of controlling said sequenced compression phases.

9. The method as set forth in claim 8, wherein said sample is quasi-isentropically heated from said sequenced compression phases.

10. The apparatus as set forth in claim 1, wherein said insensitive energetic liquid comprises nitroethane and isopropyl nitrate.

11. The apparatus as set forth in claim 9, wherein said insensitive energetic liquid comprises nitroethane and isopropyl nitrate.

* * * * *